US005583538A

United States Patent [19]

Watanabe et al.

[11] Patent Number: 5,583,538

[45] Date of Patent: Dec. 10, 1996

[54] IMAGE DISPLAY APPARATUS

[75] Inventors: Yasuhiro Watanabe; Kensaku Tanaka, both of Yokohama, Japan

[73] Assignee: Canon Kabushiki Kaisha, Tokyo, Japan

[21] Appl. No.: 445,552

[22] Filed: May 22, 1995

Related U.S. Application Data

[63] Continuation of Ser. No. 902,782, Jun. 24, 1992, abandoned, which is a continuation of Ser. No. 549,636, Jul. 6, 1990, abandoned, which is a continuation of Ser. No. 169,090, Mar. 18, 1988, abandoned, which is a continuation of Ser. No. 773,218, Sep. 6, 1985, abandoned.

[30] Foreign Application Priority Data

Sep. 19, 1984 [JP] Japan ..... 59-194752

[51] Int. Cl.[6] ..... G09G 5/34; G09G 5/08

[52] U.S. Cl. ..... 345/121; 345/145; 345/157; 345/163

[58] Field of Search ..... 345/131, 121, 345/145, 157, 163, 156; 178/18

[56] References Cited

U.S. PATENT DOCUMENTS

| | | | |
|---|---|---|---|
| 3,835,464 | 9/1974 | Rider | 340/710 |
| 4,122,438 | 10/1978 | Bird | 178/18 |
| 4,160,242 | 7/1979 | Fowler et al. | 340/711 |
| 4,197,590 | 4/1980 | Sukonick et al. | 340/726 |
| 4,442,495 | 4/1984 | Sukonick | 340/726 |
| 4,532,605 | 7/1985 | Waller | 345/131 |
| 4,552,360 | 11/1985 | Bromley et al. | 273/148 B |
| 4,580,006 | 4/1986 | Hull | 340/709 |
| 4,698,626 | 10/1987 | Sato et al. | 178/18 |
| 4,714,918 | 12/1987 | Barker et al. | 340/709 |
| 4,720,703 | 1/1988 | Schnarel, Jr. et al. | 340/709 |
| 4,734,685 | 3/1988 | Watanabe | 340/710 |
| 4,734,689 | 3/1988 | Kurakake | 340/721 |
| 4,745,405 | 5/1988 | Himelstein et al. | 340/724 |

FOREIGN PATENT DOCUMENTS

| | | | |
|---|---|---|---|
| 0108520 | 5/1984 | European Pat. Off. | 340/709 |
| 59-36843 | 2/1984 | Japan . | |

OTHER PUBLICATIONS

Williams, Gregg "The Lisa Computer System", *Byte*, Feb. 1983 pp. 33+.

*Primary Examiner*—Steven Saras

*Attorney, Agent, or Firm*—Fitzpatrick, Cella, Harper & Scinto

[57] ABSTRACT

An image display apparatus has a display memory for storing a one-frame image, a mouse for pointing a desired point on a CRT display, a keyboard including a key for instructing display area displacement, and an MPU to control display area displacement in response to operation of the key by the operator. The cursor can be displaced to a desired point on the screen to aid efficient panning without frequent shifting of the display area.

4 Claims, 5 Drawing Sheets

IMAGE DISPLAY APPARATUS

This application is a continuation of application Ser. No. 07/902,782, filed Jun. 24, 1992, which is a continuation of application Ser. No. 07/549,636, filed Jul. 6, 1990, which is a continuation of application Ser. No. 07/169,090, filed Mar. 18, 1988, which is a continuation of application Ser. No. 07/773,218, filed Sep. 6, 1985, now all abandoned.

BACKGROUND OF THE INVENTION

1. Field of the Invention

The present invention relates to an image display apparatus and, more particularly, to an image display apparatus for displaying an image larger than a display screen by panning.

2. Description of the Prior Art

There are several techniques for displaying an image larger than a display screen. In one conventional technique, an image is reduced and the reduced image is displayed over the entire screen. The overall image can easily be visually recognized, but minute details thereof cannot be precisely checked. In another conventional technique, a viewing position is shifted among displayed image portions each of which is smaller than the entire image, thereby enabling grasp of the entire image. This technique is called panning. Panning is an effective technique to check the details of an image. However, with a conventional operation using only a keyboard, an operator is overloaded when he checks the image with natural operation feeling. When only a pointing device is used, the display screen is often shifted, and the viewing position of the operator cannot be stabilized, resulting in inconvenience.

SUMMARY OF THE INVENTION

It is an object of the present invention to provide an image display apparatus for changing a display area of memory means storing image data, wherein a display area of interest is not needlessly changed unless it is designated that the display area is to be changed.

It is another object of the present invention to provide an image display apparatus wherein part of the display area stored in the memory means is updated when a cursor exceeds the display area, i.e., when the cursor is shifted outside the display screen.

It is still another object of the present invention to provide an image display apparatus wherein a displacement amount of the cursor for unit operation of cursor displacement means is set to be variable to speed up displacement of the cursor when the cursor is shifted by the cursor displacement means.

It is still another object of the present invention to provide an image display apparatus for shifting a pointing device to displace the display areas wherein a ratio of a displacement amount of the display area to that of the pointing device is set to immediately and easily display a desired area stored in the memory means.

DETAILED DESCRIPTION OF THE PREFERRED EMBODIMENT

Figure 1:
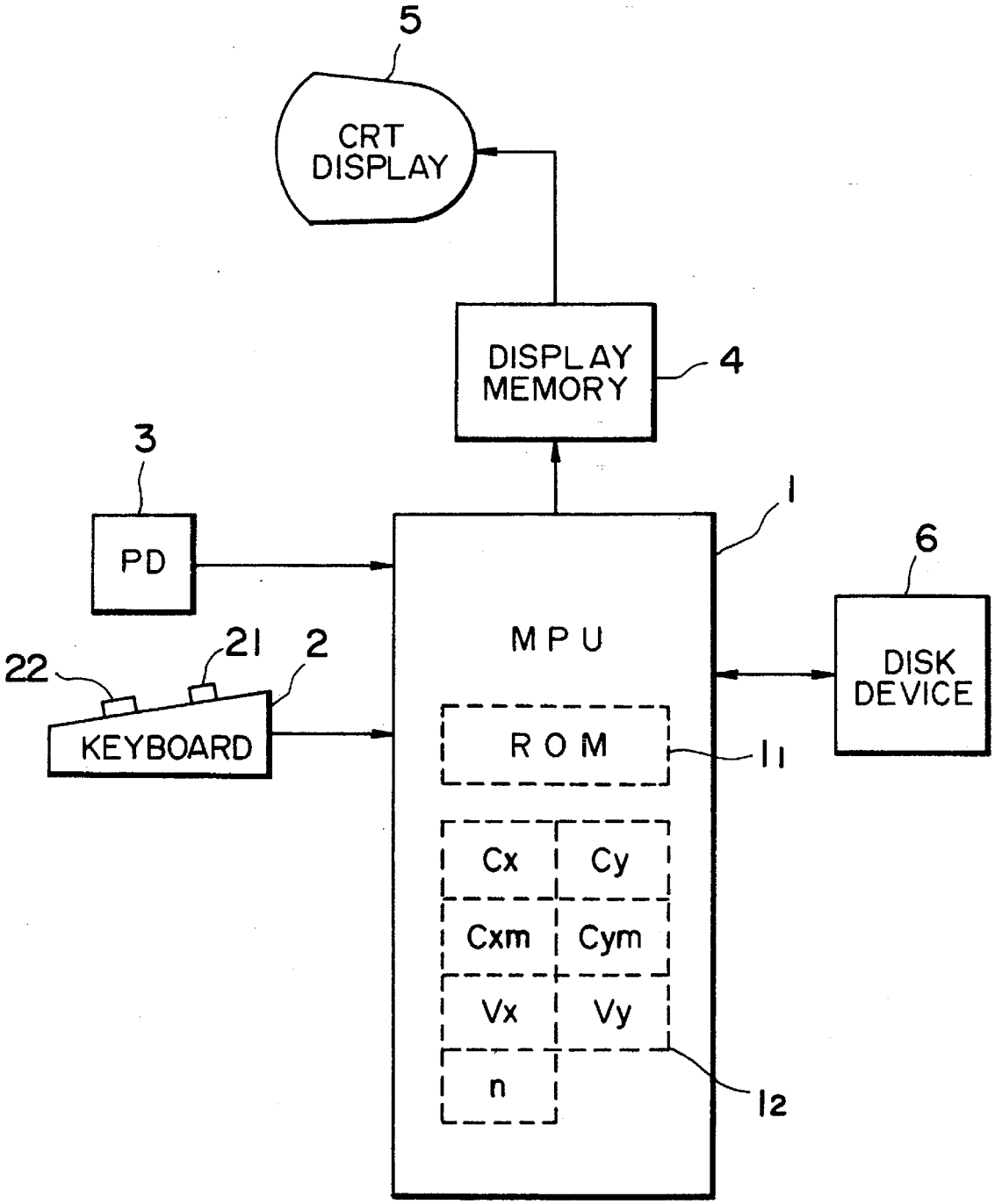
FIG. 1 is a block diagram of an image display apparatus according to an embodiment of the present invention.

An image display apparatus according to an embodiment of the present invention will be described with reference to the accompanying drawings. FIG. 1 is a block diagram of the image display apparatus according to the embodiment of the present invention. Referring to FIG. 1, a microprocessing unit (MPU) 1 incorporates a ROM $\mathbf{1}_1$ and a RAM $\mathbf{1}_2$ and performs general data processing and panning display control. The ROM $\mathbf{1}_1$ stores control programs shown in FIGS. 4A and 4B and FIG. 5. The RAM $\mathbf{1}_2$ includes a register for storing coordinates (Cx, Cy) of a cursor K, a register for storing maximum coordinates (Cxm, Cym) of the cursor K, a register for storing display area coordinates (Vx, Vy) and a register for storing a predetermined value n. A keyboard 2 has a slide switch 22 for presetting the predetermined value n and a specific key 21 (to be described later). A pointing device (PD) 3 is called a mouse. An external disk device 6 stores image information. The image display apparatus also includes a display memory 4 for storing a one-frame image, and a raster scan type CRT display 5 for reading out a partial image from the display memory 4 and for displaying the readout image.

Figure 2A:
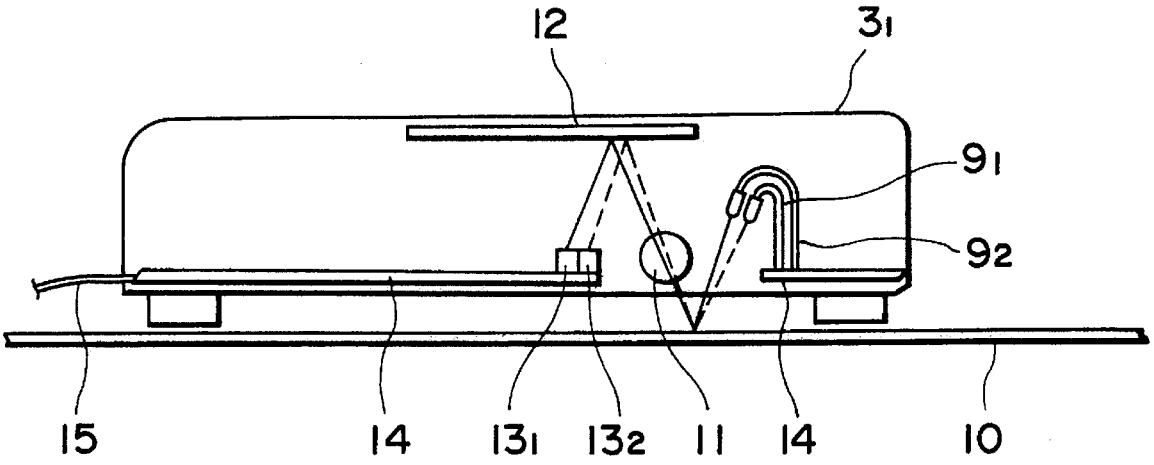
FIGS. 2A and 2B are respectively sectional views of a pointing device and a matrix pad thereof.
Figure 2B:
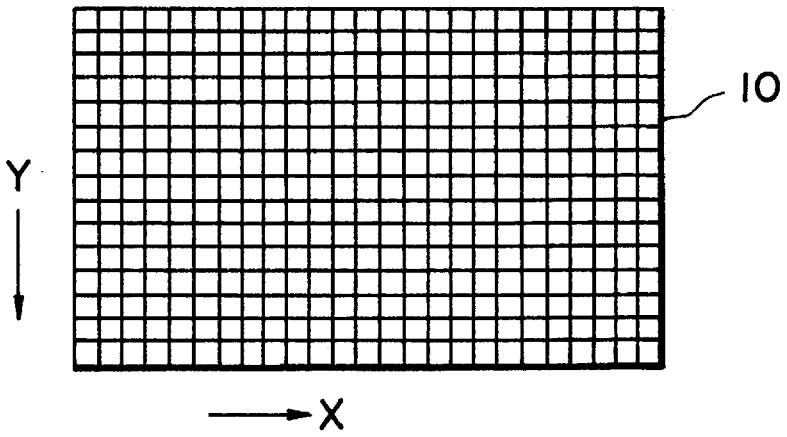

FIG. 2A is a sectional view showing the structure of the PD 3. The PD 3 has two LED's $\mathbf{9}_1$ and $\mathbf{9}_2$ as two light sources having different wavelengths. Light beams emitted from the LED's $\mathbf{9}_1$ and $\mathbf{9}_2$ are reflected by the surface of a pad 10. Reflected light beams are focused by a spherical lens 11, and focused beams are reflected by a reflecting mirror 12 and are detected by photosensors $\mathbf{13}_1$ and $\mathbf{13}_2$. Matrix lines are drawn on the surface of the pad 10, as shown in FIG. 2B. The vertical and horizontal lines are printed in a color for selectively reflecting the beams from the light sources $\mathbf{9}_1$ and $\mathbf{9}_2$. When an operation unit $\mathbf{3}_1$ is moved along the pad 10, the photosensors $\mathbf{13}_1$ and $\mathbf{13}_2$ detect that the beams cross the vertical and horizontal lines. By detecting the number of edges of the vertical and horizontal lines and counting their number, a displacement amount of the operation unit $\mathbf{3}_1$ is detected. A board 14 mounts the above-mentioned components and a processing unit. A cable 15 is connected to the MPU 1.

Such a pointing device is commercially available and a typical example is an optical mouse available from Mouse Systems Corp., U.S.A. When the operation unit $\mathbf{3}_1$ is moved to the right along the X-axis of the pad, a $+\Delta x$ signal is generated for every predetermined displacement. However, when the unit $\mathbf{3}_1$ is moved to the left for every predetermined displacement, a $-\Delta x$ signal is generated. This operation can also be applied to the operation for the Y-axis. Oblique displacements can be detected by combinations of $\pm\Delta x$ and $\pm\Delta y$ signals. In the apparatus of the above embodiment, a PD of the type described above is used to designate displacement of the display area.

Figure 3:
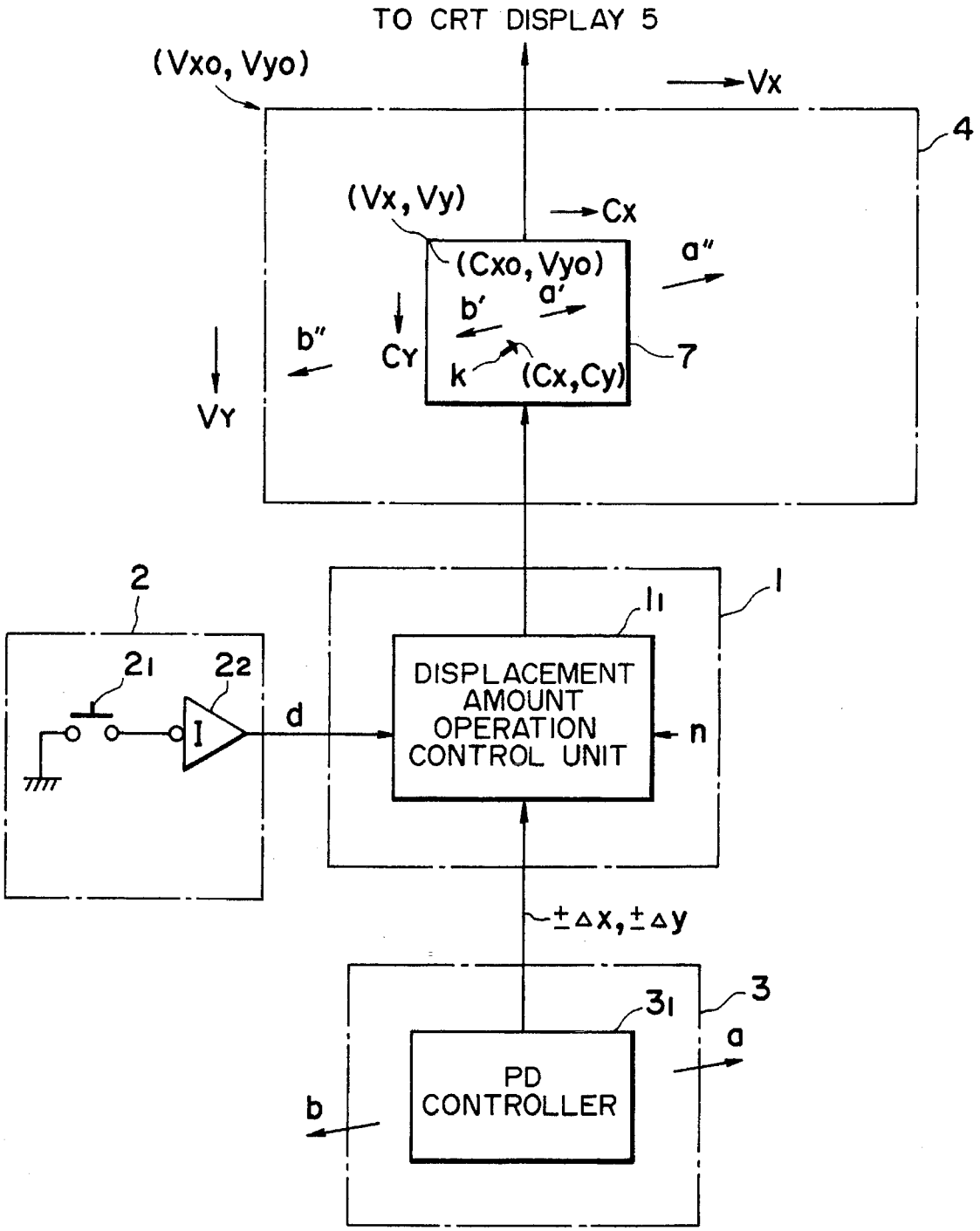
FIG. 3 is a diagram for explaining the principle of operation of the apparatus shown in FIG. 1.

FIG. 3 is a block diagram for explaining the principle of operation of the apparatus of this embodiment. Any point (Vx, Vy) in the display memory 4 is determined by a displacement Vx along the Vx-axis from the origin (Vx0, Vy0) and a displacement Vy along the Vy-axis therefrom. The point (Vx, Vy) also serves as the origin (Cx0, Cy0) in a display area 7. Any point (Cx, Cy) representing the position of a cursor K in the display area 7 is determined by a displacement Cx along the Cx-axis from the origin (Cx0, Cy0) and a displacement Cy along the Cy-axis therefrom. When the point (Vx, Vy) is changed upon an external operation, the display area 7 is shifted within the display memory 4. When the point (Cx, Cy) is moved, the cursor K is shifted within the display area 7.

The keyboard 2 has the specific key $2_1$. An output from the specific key $2_1$ is inverted by an inverter $2_2$. An inverted signal comprises a discrimination signal d for determining whether or not the display area 7 is moved within the display memory 4. The specific key $2_1$ may be arranged in the PD 3 in place of the keyboard 2. The operation unit $3_1$ of the PD 3 selectively generates displacement amount signals $\pm\Delta x$ and $\pm\Delta y$. A displacement amount operation control unit $1_1$ updates the x and y addresses (Cx, Cy) of the cursor K in accordance with the displacement amount signals $\pm\Delta x$ and $\pm\Delta y$. At the same time, the displacement amount operation control unit $1_1$ determines in response to the discrimination signal d whether or not the display area 7 is moved. For example, when the signal d is set at logic "0" and the operation unit $3_1$ is moved along the a or b direction, the cursor K is moved in the display area 7 along the a' or b' direction. However, when the signal d is set at logic "1" and the operation unit $3_1$ is moved along the a or b direction, the display area 7 is moved in the display memory 4 along the a" or b" direction. In this case, the constant n determines a ratio of the displacements $\pm\Delta x$ and $\pm\Delta y$ of the operation unit $3_1$ to that of the cursor K in the display area 7 and is set to be ¼, ½, 1, 2, 4, . . . upon operation of a slide switch 22 on the keyboard 2. For example, if n=2, the displacement amount of the screen is twice that of the operation unit $3_1$. However, if n=½, the displacement amount of the screen is ½ of the displacement amount of the operation unit $3_1$.

Figure 4B:
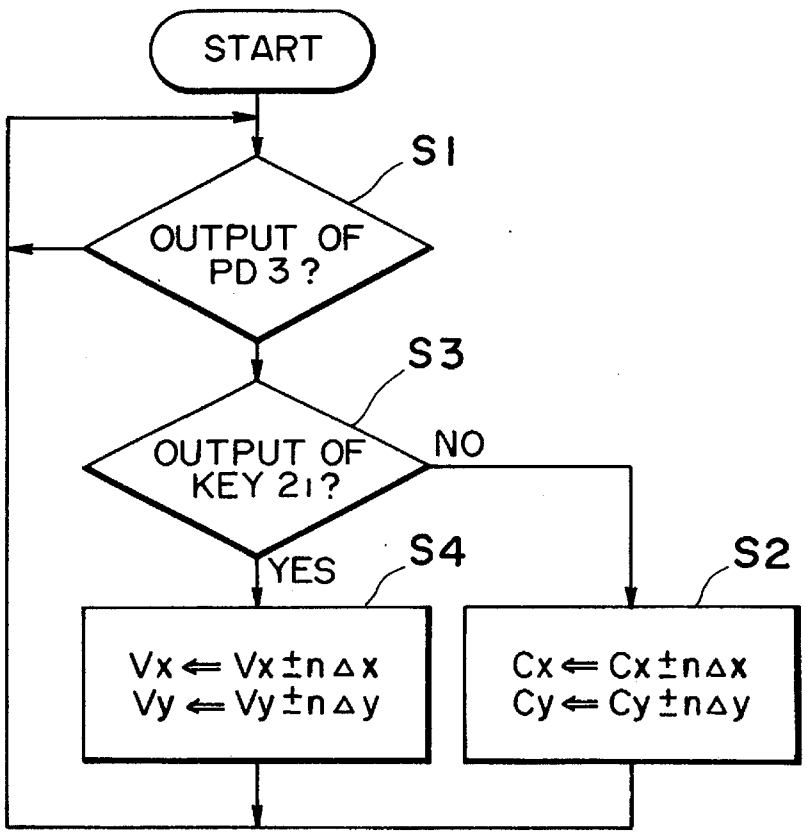
FIGS. 4A and 4B are respectively flow charts for explaining cursor displacement and panning.
Figure 4A:
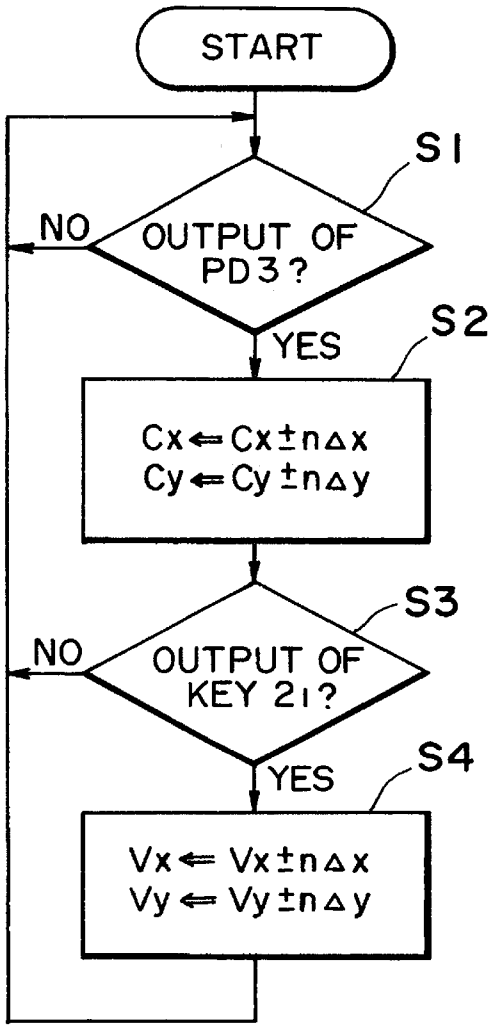
Figure 5:
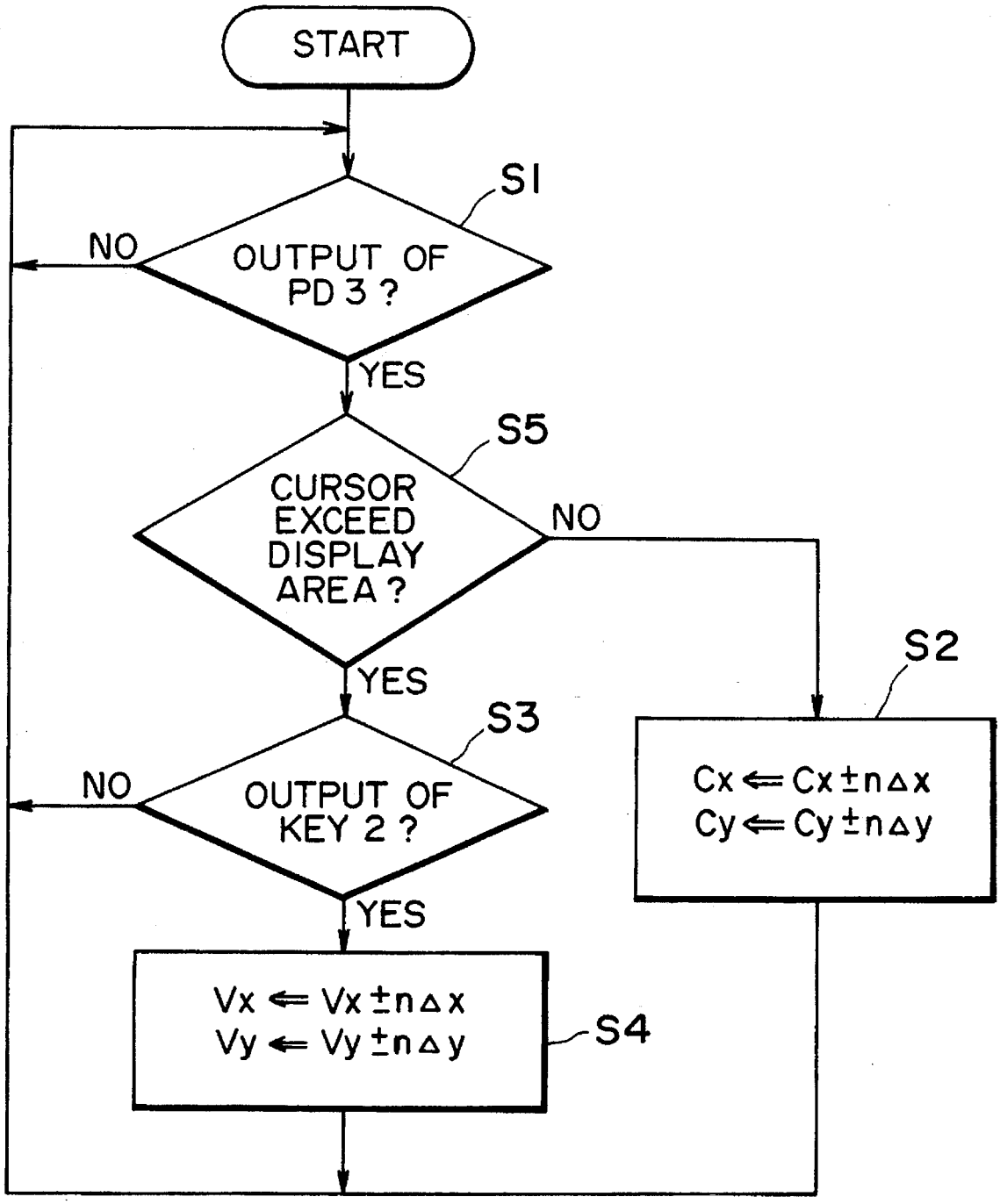
FIG. 5 is a flow chart showing another control program for cursor displacement and panning.

FIGS. 4A and 4B are respectively flow charts for explaining cursor shifting and panning. Referring to FIG. 4A, an output from the PD 3 is monitored in step S1. If the PD 3 is moved and outputs $\pm\Delta x$ and $\pm\Delta y$ therefrom are detected, the flow advances to step S2. In step S2, the cursor K is shifted. If the coordinates of the cursor on the display area 7 are given as (Cx, Cy), the displacement amount outputs $\pm\Delta x$ and $\pm\Delta y$ are multiplied with the proper constant n, and the products are added to Cx and Cy, thereby obtaining the shifted position of the cursor K. In this case, when the calculated results exceeds the maximum values Cxm or Cym which represent the maximum values of the coordinates of the cursor K, the cursor K can be looped and plotted from the zero point. Alternatively, a maximum added is determined to prevent the sum from exceeding the maximum value Cxm or Cym. In this case, when the cursor K is moved to the end of the screen, it will not further be shifted. In step S3, an output from the key $2_1$ is checked. When the MPU 1 determines that the key $2_1$ is depressed, i.e., the MPU 1 detects that the signal d is set at logic "1", and the flow advances to step S4. In step S4, the display area 7 is shifted. Similarly, if the coordinates of the display area 7 are given as (Vx, Vy), the displacement amount outputs $\pm\Delta x$ and $\pm\Delta y$ are multiplied with the proper constant n and the products are added to Vx and Vy, thereby obtaining the shifted position of the display area 7. When the key $2_1$ is not depressed, only the cursor K is displaced. However, when the key $2_1$ is depressed, the cursor K and the display area 7 are moved together.

FIG. 4B shows a different displacement from that of FIG. 4A. The same block numbers as in FIG. 4B denote the same steps as in FIG. 4A, and a detailed description thereof will be omitted. Differences between the flow charts of FIGS. 4A and 4B are given as follows. Referring to FIG. 4B, when the output from the key $2_1$ is discriminated by step S3 to be set at logic "1", only the display area 7 is displaced in step S4. However, when the output from the key $2_1$ is discriminated by step S3 to be set at logic "0", only the cursor K is displaced in step S2. When the key $2_1$ is depressed, panning is performed. The cursor K is displaced together with panning. As a result, the cursor K is kept unmoved at the screen position. However, when the key $2_1$ is not depressed, only the cursor K is displaced, and panning is not performed. In this manner, panning can be selectively performed to satisfy the operation purposes.

In the above embodiment, panning is performed without conditions when panning is designated. However, a condition may be provided not to perform panning when the cursor K is located within the display area 7 and to perform panning when the cursor K exceeds it. For this purpose, there is illustrated a flow chart in FIG. 5. In step S1, the output from the PD 3 is monitored. When an output is detected, the MPU 1 checks in step S5 the position when the cursor K is moved. This checking is performed so as to determine whether or not the sum of the current position of the cursor K and the PD 3 output exceeds the maximum value Cxm or Cym. When the MPU 1 determines that the cursor K stays within the display area 7 even after the cursor K is displaced, the cursor K is displaced in step S2. When the MPU 1 determines that the cursor K exceeds the display area 7, the flow advances to step S3. The MPU 1 checks the output from the key $2_1$ in step S3. When the MPU 1 determines that the key $2_1$ is not depressed, panning is not performed. However, if YES in step S3, the display area 7 is displaced in step S4. The cursor K is moved to a screen edge in the desired direction. When a further displacement request is present, automatic panning can be performed.

According to the present invention, when a large image is displaced on a small display screen, image search based on operator estimate can be performed. Furthermore, panning can be selectively performed upon operation of the specific key, thereby preventing wasteful screen displacement and stabilizing the field of view.

What we claim is:

1. An image display apparatus comprising:

memory means for storing image data;

display means for displaying part of the image data in said memory means;

a pointing device moved along a given plane so as to designate a displacement amount of the display of said part of the image data in said memory means which can be displayed on said display means while the displayed part moves;

ratio setting means for manually setting a ratio of displacement amount of said pointing device to the displacement amount of the display of said part of the image data of said memory means; and calculating means for calculating the displacement amount of said memory means in accordance with the ratio set by said ratio setting means and an instruction of said pointing device.

2. An apparatus according to claim 1, wherein said memory means comprises a random access memory.

3. An apparatus according to claim 1, wherein said display means comprises a cathode-ray tube.

4. An image displaying method comprising the steps of:

displaying part of image data stored in memory means;

moving a cursor along a given plane so as to designate a displacement amount of the display of the part of the image data in the memory means which can be displayed in said displaying step while the displayed part moves, the cursor being moved by a pointing device;

manually setting a ratio of displacement of the pointing device to the displacement amount of the display of the part of the image data of the memory means; and calculating the displacement amount of the memory means in accordance with the ratio set in said manually setting step and an instruction of the pointing device.

* * * * *